United States Patent [19]

Canup et al.

[11] 4,341,196

[45] Jul. 27, 1982

[54] IGNITION INITIATING SIGNAL FROM A FUEL INJECTION NOZZLE VALVE

[75] Inventors: Robert E. Canup, Poughkeepsie; Martin Alperstein, Fishkill, both of N.Y.

[73] Assignee: Texaco Inc., White Plains, N.Y.

[21] Appl. No.: 200,620

[22] Filed: Oct. 27, 1980

[51] Int. Cl.[3] ..... F02P 1/00

[52] U.S. Cl. ..... 123/643; 123/612; 123/606; 123/146.5 A; 123/445

[58] Field of Search ..... 123/612, 606, 607, 643, 123/146.5 A, 478, 445, 416

[56] References Cited

U.S. PATENT DOCUMENTS

| | | | |
|---|---|---|---|
| 4,022,177 | 5/1977 | Canup et al. | 123/606 |
| 4,096,841 | 6/1978 | Kindermann et al. | 123/445 |
| 4,111,178 | 9/1978 | Casey | 123/416 |
| 4,170,208 | 10/1979 | Katsumata et al. | 123/643 |
| 4,176,643 | 12/1979 | Beeghly | 123/643 |
| 4,203,404 | 5/1980 | Canup | 123/643 |

FOREIGN PATENT DOCUMENTS

| | | | |
|---|---|---|---|
| 2252026 | 6/1975 | France | 123/643 |

*Primary Examiner*—P. S. Lall

*Attorney, Agent, or Firm*—Carl G. Ries; Robert A. Kulason; Henry C. Dearborn

[57] ABSTRACT

An ignition initiating signal is developed from the fuel injection nozzle valve of an internal combustion engine. The valve is actuated by fuel pressure which creates an insulating layer at the valve so that when the valve is unseated an electrical circuit is broken to create the ignition initiating signal. And, electrical circuit means are included which limit the voltage applied and the current flow at the valve seat in order to avoid breakdown of the fuel insulating layer and pitting of the valve seat.

7 Claims, 1 Drawing Figure

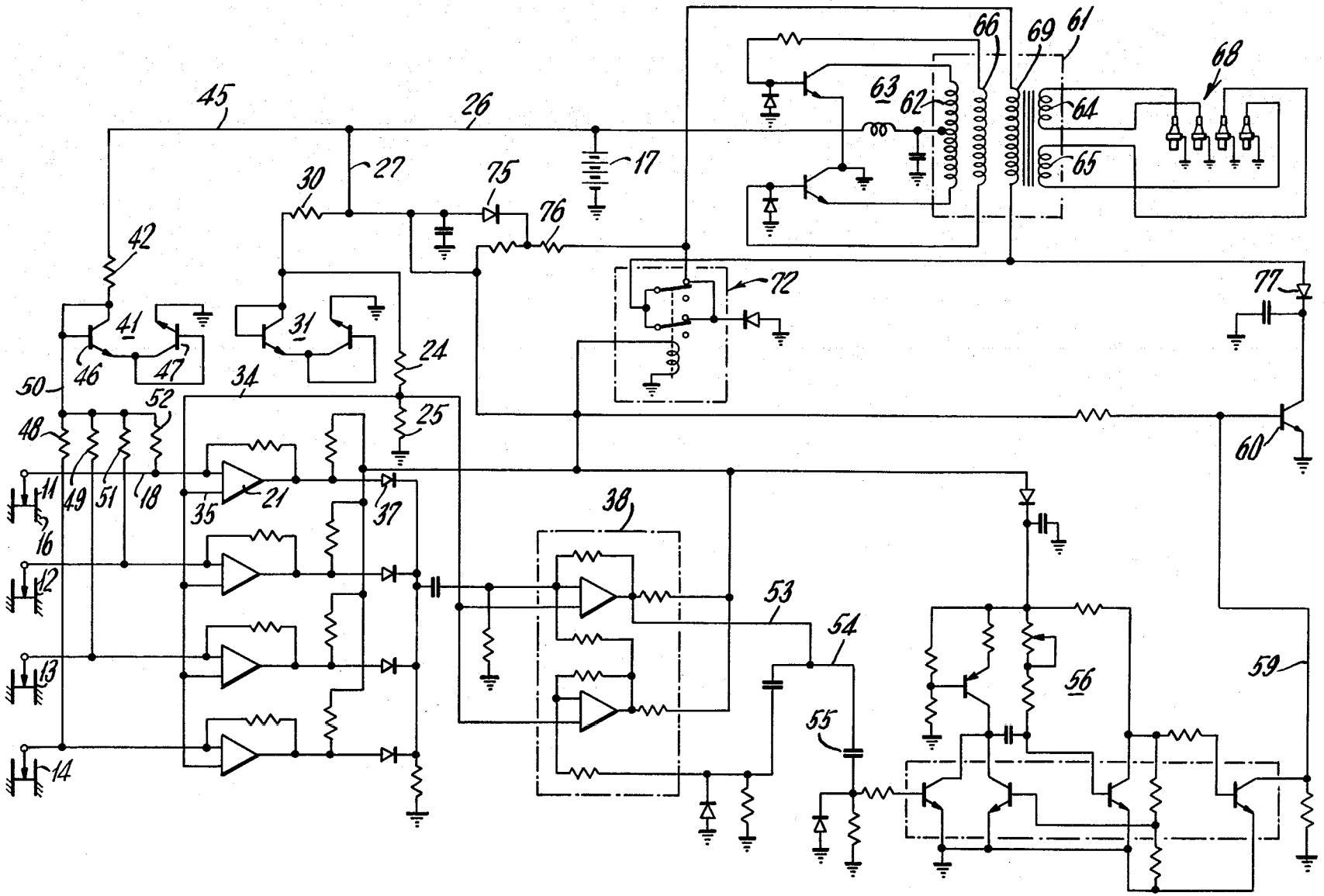

IGNITION INITIATING SIGNAL FROM A FUEL INJECTION NOZZLE VALVE

BACKGROUND OF THE INVENTION

1. Field of the Invention

This invention relates to an improved ignition system for an internal combustion engine where the ignition signal is initiated at a fuel injection valve. In particular, the invention deals with a means for limiting both voltage and current of a control signal for an ignition system of the type indicated.

2. Description of the Prior Art

Heretofore, ignition systems have been proposed which made use of a signal related to the operation of a fuel injector in an internal combustion engine which employed such an ignition system. However, no known ignition system of that type was concerned with, nor was there any appreciation of, a problem that relates to the actual usage of an ignition control signal developed at an injector valve.

Examples of the foregoing known systems are two U.S. Pat. No. 4,096,841 and U.S. Pat. No. 4,111,178. In the former, there are magnetic pick-ups employed at the fuel injection nozzles of the system, and consequently the problem of concern in this application does not arise. As to the latter, there is no concern with nor any mention of the problem that the applicants have dealt with.

Thus, it is an object of this invention to provide for particular means applicable to an ignition system employed with an internal combustion engine, wherein the system employs a fuel injection nozzle valve for producing an ignition spark control signal.

More specifically, it is an object of this invention to provide means to avoid breakdown of the insulating effect of a fuel film at a fuel injection nozzle valve, in addition to eliminating pitting at the valve seat.

SUMMARY OF THE INVENTION

Briefly, the invention relates to an ignition system for an internal combustion engine wherein said system employs a fuel injection nozzle valve for producing an ignition spark control signal. The injection nozzle valve is actuated by fuel pressure to inject said fuel, and said fuel pressure creates an electrically insulating layer at said valve when said fuel is injected. The said valve creates said control signal when it is unseated. In connection with such ignition system, the improvement comprises electrical circuit means for limiting both voltage and current of said control signal to eliminate breakdown of said insulating layer and pitting of said valve seat.

Again briefly, the invention relates to an ignition system for an internal combustion engine wherein said system employs a fuel injection nozzle valve for producing an ignition spark control signal. The said injection nozzle valve is actuated by fuel pressure to inject said fuel, and the said fuel pressure creates an electrically insulating layer at said valve when said fuel is injected. The said valve creates said control signal when it is unseated. In such ignition system the improvement comprises electrical circuit means for limiting both voltage and current of said control signal in order to eliminate breakdown of said insulating layer and pitting of said valve seat. The said electrical circuit means comprises a constant voltage unit for limiting the voltage amplitude of said signal. It has a first resistor in series with a pair of transistors connected with the collector to emitter paths in series and with each base electrode connected to its collector. The circuit means also comprises a second resistor in series with the output of said constant voltage unit for limiting the current amplitude of said signal.

BRIEF DESCRIPTION OF THE DRAWING

The foregoing and other objects and benefits of the invention will be more fully set forth below in connection with the best mode contemplated by the inventors of carrying out the invention, and in connection with which there are illustrations provided in the drawing, wherein:

The FIGURE of drawings is an electrical circuit diagram illustrating a system which includes the elements according to the invention.

DESCRIPTION OF THE PREFERRED EMBODIMENT

In making use of an ignition system for an internal combustion engine which system is like that disclosed and described in our earlier application, Ser. No. 048,867 filed June 15, 1979, it has been discovered that under certain conditions the system would not operate properly. Thus, when the Robert Bosch type of fuel injection nozzle valve was employed, the fuel film (as the valves were actuated) was such that the voltage applied had to be limited to a very low value in order to avoid breakdown of the film of fuel. In addition, when either type of fuel injection valve was employed, it was discovered that there was a tendency for pitting to occur at the valve seat.

With reference to the FIGURE of drawings, it is pointed out that the system to which this invention applies involves an ignition system for an internal combustion engine. The system illustrated employs a fuel injection nozzle valve in order to produce an ignition spark control signal. It will be understood that there is an individual nozzle valve for each cylinder, and such fuel injector valve may be any of various standard types so long as it has the required structure that is ordinarily to be found in such valves. Such structure is indicated in our aforementioned earlier application.

As indicated in the earlier application, examples of standard injector valves which are commercially available include those manufactured by Stanadyne of Hartford, Connecticut and designated Roosa Master Pencil Nozzles. Similarly, another commercially available type is that manufactured by Robert Bosch, GMBH of Stuttgart, West Germany which has nozzle bodies designated KDALZ and which take DLUZ nozzle tips, as well as nozzle bodies KDAL with tips DLLA.

In the ignition system illustrated in the FIGURE of drawings there are four fuel injection nozzle valves 11, 12, 13, and 14. These are schematically indicated and it will be noted that they are of the type indicated above, both of which are actuated by fuel pressure to inject fuel into the cylinders. And, the fuel pressure which actuates the valves creates an electrically insulating layer at the valve when the fuel is injected. As each valve is unseated, there is a control signal created in each circuit. For example, when valve 11 is actuated, the unseating of the valve will cause a break in the electrical circuit that goes from a source of power, e.g. a battery 17, to electrical ground (schematically indicated by reference number 16) at the valve 11. This circuit is completed via the electrical ground to the other side of the battery 17.

The indicated break in that circuit changes the potential on a circuit connection 18 from ground to a potential which is determined according to elements of this invention, as will be explained more fully below. Thus, when the valve 11 is closed the potential on circuit connection 18 will be at ground potential and there will be no output signal from a comparator 21. The comparator 21 has one input connected via the circuit connection 18, while the other input is connected to a predetermined voltage. This predetermined voltage is determined by a potentiometer formed by a pair of resistors 24 and 25. The resistors 24 and 25 are connected in series from a constant voltage that is derived from the battery 17 via a circuit connection 26 and another connection 27 to another resistor 30. Resistor 30 is part of a constant current circuit 31. In this manner the comparator input voltage that is determined by the potentiometer 24-25 is applied over a circuit connection 34 to an input connection 35 of comparator 21. Of course, the connection 34 also goes to each of the other comparators indicated which are connected to the other fuel injector valves 12, 13 and 14.

When valve 11 is unseated, the voltage on circuit connection 18 will rise and exceed the comparator voltage on the other input 35 of comparator 21. That voltage, of course, is determined by the potentiometer 24, 25 and it exists on the connection 34, as described above. The output of comparator 21 goes via a diode 37 to one input of a lockout circuit 38 for preventing any spurious signals after the initial valve lift from having any effect.

In order to limit the voltage and current of the control signal that is created (as the valve plunger is unseated), there is a constant voltage regulator 41 that applies a predetermined low voltage to each valve in order to prevent breakdown of the insulating layer created by the fuel being injected at each valve.

Thus, for example, the constant voltage regulator 41 includes a resistor 42 that is connected in series with the battery voltage from the battery 17 via the circuit connection 26 and another connection 45 to one end of the resistor 42. The other end of resistor 42 is connected to the first of a pair of transistors 46 and 47 which are connected with the collector-to-emitter path of each in series (as shown) and with the base electrode of each connected to its collector. Such a pair of transistors, i.e. 46 and 47, acts as a constant current element so that the current through the resistor 42 is maintained constant. As a result, the voltage at the end of resistor 42 adjacent to the transistor 46 will also be held constant. This constant voltage is applied via a circuit connection 50 to one end of each of a group of resistors 48, 49, 51 and 52 which are each connected to a corresponding one of the injector valves 14, 13, 12 and 11 respectively. These resistors are each in series with the output of the constant voltage unit 41, i.e. with respect to the injection nozzle valves 11–14. Consequently, each resistor 48, 49, 51 and 52 acts to limit the current amplitude of the signal created at each value as the individual valve plunger becomes unseated.

Thus, with reference to the fuel injector valve 11, for example, the output voltage on circuit connection 50 is carried from the output of the constant voltage regulator 41 to one end of the resistor 52 that has the other end thereof connected to the circuit connection 18 which leads from the nozzle valve 11 to one input of the comparator 21. The other input of comparator 21 has the predetermined voltage (described above) applied via connection 35 so that as soon as the voltage caused by unseating of the valve 11 exceeds that from the potentiometer 24-25, the comparator 21 will change state and so send an ignition spark control signal via the diode 37 indicated above.

It may be noted that the invention according to this application is applicable to an ignition system that is for an internal combustion engine wherein the system employs a fuel injection nozzle valve for producing an ignition spark control signal. The injection nozzle valve is actuated by fuel pressure to inject the fuel, and the fuel pressure creates an electrically insulating layer at the valve when the fuel is injected. Furthermore, the valve creates the control signal when it is unseated. An ignition system of the foregoing type is illustrated in the drawing. And, it will be appreciated that the particular type of spark signal that is developed at the spark plugs of the ignition system, might vary. It is the control signal being created by the unseating of each fuel injection nozzle valve, that is at the heart of this invention.

An ignition spark signal of the type that may be employed with this invention is illustrated and described in our aforementioned co-pending application which makes reference to earlier patents assigned to the same assignee as this application. Such earlier patents are U.S. Pat. No. 4,203,404 issued May 20, 1980 and U.S. Pat. No. 4,022,177 issued May 10, 1977. Thus, the output of the lockout circuit 38 goes via circuit connections 53, 54 and a capacitor 55 to an inverse (with repetition rate) pulse-width circuit 56. This pulse-width circuit 56 has its output connected via a circuit connection 59 to the base electrode of an electronic-switch transistor 60 that controls the duration of high frequency square wave AC spark signals.

The indicated high tension electric spark generation is provided for by a transformer 61 that supplies high-voltage high-frequency spark signals from a pair of secondary, or output high-voltage windings 64 and 65 to a plurality of spark plugs 68, as indicated. The transformer 61 includes a center tapped primary winding 62, along with a feedback winding 66 which together are employed in an oscillator circuit 63, such as is clearly explained in the abovementioned patents. In addition, there is a control winding 69 which controls the time duration of the continuous AC type sparks as determined by the beginning and ending of periods of oscillation of the oscillator 63. Such oscillation control of stopping and starting is determined by the electronic switch, i.e. transistor 60. This transistor (spark control switch) is in series with the source of DC current supply which is the battery 17. The control circuit goes to the upper end (as viewed in the FIGURE of drawing) of the control winding 69 via a diode 75 and a resistor 76. The lower end of the control winding 69 goes to the transistor switch 60 via another diode 77.

There is a relay 72 shown that has circuit connections to the control winding 69. However, the details need not be described here as they are not relevant to this invention. The purpose of the relay 72 is to ensure shutdown of the oscillator 63 whenever the ignition system is turned off.

It will be understood that the foregoing description concerning the action relating to a single one of the fuel injector valves, i.e. valve 11, has been described. However, the same principles and action apply to each of the other fuel injector valve elements 12, 13, and 14 and the valves are, of course, actuated sequentially as the internal combustion engine operates.

As has been noted above, it will be appreciated that some types of fuel injector nozzles may have different characteristics from others viz-a-viz the amount of insulating fuel film that is created as the operation thereof takes place. Consequently, the voltage limitation, according to this invention, that is required may vary for the different types of injectors. It has been found that a Bosch type nozzle requires a low voltage and, on the other hand, the Roosa type nozzles may have considerably higher voltage supplied without the fuel film insulating layer breaking down. In either case, however, the series resistor employed for limiting the current flow through the fuel nozzle valve, would be designed to ensure a proper limitation for the amount of current flow. The latter maintains the operation without causing any substantial pitting at the nozzle valve seats.

While a particular embodiment of the invention has been described above in considerable detail in accordance with the applicable statutes, this is not to be taken as in any way limiting the invention but merely as being descriptive thereof.

We claim:

1. In an ignition system for an internal combustion engine wherein said system employs a fuel injection nozzle valve for producing an ignition spark control signal, said injection nozzle valve being actuated by fuel pressure to inject said fuel, said fuel pressure creating an electrically insulating layer at said valve when said fuel is injected, and said valve creating said control signal when unseated, the improvement comprising electrical circuit means for limiting both voltage and current of said control signal to eliminate breakdown of said insulating layer and pitting of said valve seat.

2. In an ignition system according to claim 1, wherein said electrical circuit means comprises first circuit means for limiting said signal to a predetermined constant voltage, and second circuit means for limiting the current amplitude of said signal.

3. In an ignition system according to claim 2, wherein said first circuit means comprises a constant voltage unit, and said second circuit means comprises a resistor.

4. In an ignition system according to claim 3, wherein said constant voltage unit comprises a pair of transistors.

5. In an ignition system according to claim 4, wherein said constant voltage unit also comprises a resistor in series with said pair of transistors.

6. In an ignition system according to claim 5, wherein said pair of transistors are connected with the collector to emitter paths in series and with each base connected to its collector.

7. In an ignition system for an internal combustion engine wherein said system employs a fuel injection nozzle valve for producing an ignition spark control signal, said injection nozzle valve being actuated by fuel pressure to inject said fuel, said fuel pressure creating an electrically insulating layer at said valve when said fuel is injected, and said valve creating said control signal when unseated, the improvement comprising electrical circuit means for limiting both voltage and current of said control signal to eliminate breakdown of said insulating layer and pitting of said valve seat, said electrical circuit means comprising a constant voltage unit for limiting the voltage amplitude of said signal and having a first resistor in series with a pair of transistors connected with the collector to emitter paths in series and with each base connected to its collector, and a second resistor in series with the output of said constant voltage unit for limiting the current amplitude of said signal.

* * * * *